United States Patent [19]

Melnik et al.

[11] Patent Number: 4,913,110

[45] Date of Patent: Apr. 3, 1990

[54] BYPASS ELECTRONIC EMERGENCY FUEL SYSTEM

[75] Inventors: George Melnik, New Castle County, Del.; Bruce Amrein; Curtis L. McCoy, Both of Herford County, Md.; James A. Martin, Lancaster County, Pa.; Robert C. Brucksch, Harford County, Md.

[73] Assignee: The United States of America as represented by the Secretary of the Army, Washington, D.C.

[21] Appl. No.: 348,752

[22] Filed: May 1, 1989

[51] Int. Cl.[4] ..... F02B 77/00

[52] U.S. Cl. ..... 123/198 D; 123/458

[58] Field of Search ..... 123/198 D, 198 DB, 458, 123/479

[56] References Cited

U.S. PATENT DOCUMENTS 4,334,406 6/1982 Todd ..... 123/198 D 4,476,825 10/1984 Mills ..... 123/198 D

*Primary Examiner*—Noah P. Kamen

*Attorney, Agent, or Firm*—Peter A. Taucher; David L. Kuhn

[57] ABSTRACT

Disclosed is an emergency bypass mechanism to route fuel around an electronically controlled fuel flow regulator of a combat vehicle when flow through the regulator becomes severely restricted. The mechanism includes electrically actuated valves hydraulically in parallel with the regulator, the valves being partly controlled by signals generated during manually shifting of the vehicle's transmission and partly controlled by a system of switches in a control panel.

11 Claims, 2 Drawing Sheets

BYPASS ELECTRONIC EMERGENCY FUEL SYSTEM

GOVERNMENT INTEREST

The invention described herein may be manufactured, used, and licensed by or for the Government for governmental purposes, without payment to me of any royalty thereon.

BACKGROUND AND SUMMARY

This mechanism relates to control mechanisms for drive trains of vehicles and more particularly relates to a bypass mechanism operable by the vehicle driver to route fuel around an electronically controlled fuel injection system.

The U.S. Army uses a fuel injection device known as an HMU, or hydromechanical unit, on its M1 and M1A1 Tanks. The HMU is an assembly of electronically actuatable valves and other components which are controlled by an ECU (electronic control unit). To prevent engine damage the ECU is programmed to initiate several protective modes and reduces fuel flow from the HMU if certain performance irregularities occur in the engine or its control systems. In one of the protective modes, referred to as "protective mode III", the flow rate of fuel to the engine is reduced to about 120 lbs/hour, so the engine generates only about 72 hp, or 5 percent of its capacity. In this condition the tank is limited to a maximum speed of 1 mph.

In a battle or emergency scenario, it may be necessary to drive the tank faster than protective mode III permits. Further. it is possible that battle damage could cut off electrical power to the ECU and thereby adversely limit fuel flow to the engine.

To address these difficulties, we have created a fuel bypass device which can route additional fuel to the engine during protective mode III or during failure of the ECU. Our bypass device is independent of the ECU and comprises a modular add-on unit which can be retrofitted on tanks without disassembly of HMUs or modification of ECU logic. The device includes a set of fixed-oriface valves connected in parallel with one another, this set of valves being operable to effect stepwise increases or decreases of fuel flow to the engine. The control circuitry for the solenoid-actuated valves includes a means to shut them off automatically when the transmission is moved out of the "drive" or "reverse" gear range. The automatic shut off is advantageous because potential damage can be caused by over-revving of the tank's engine if it receives too much fuel while not under load. An absence of load on the engine occurs, for example, when the automatic transmission is in the "neutral" gear range.

DETAILED DESCRIPTION

Figure 1:
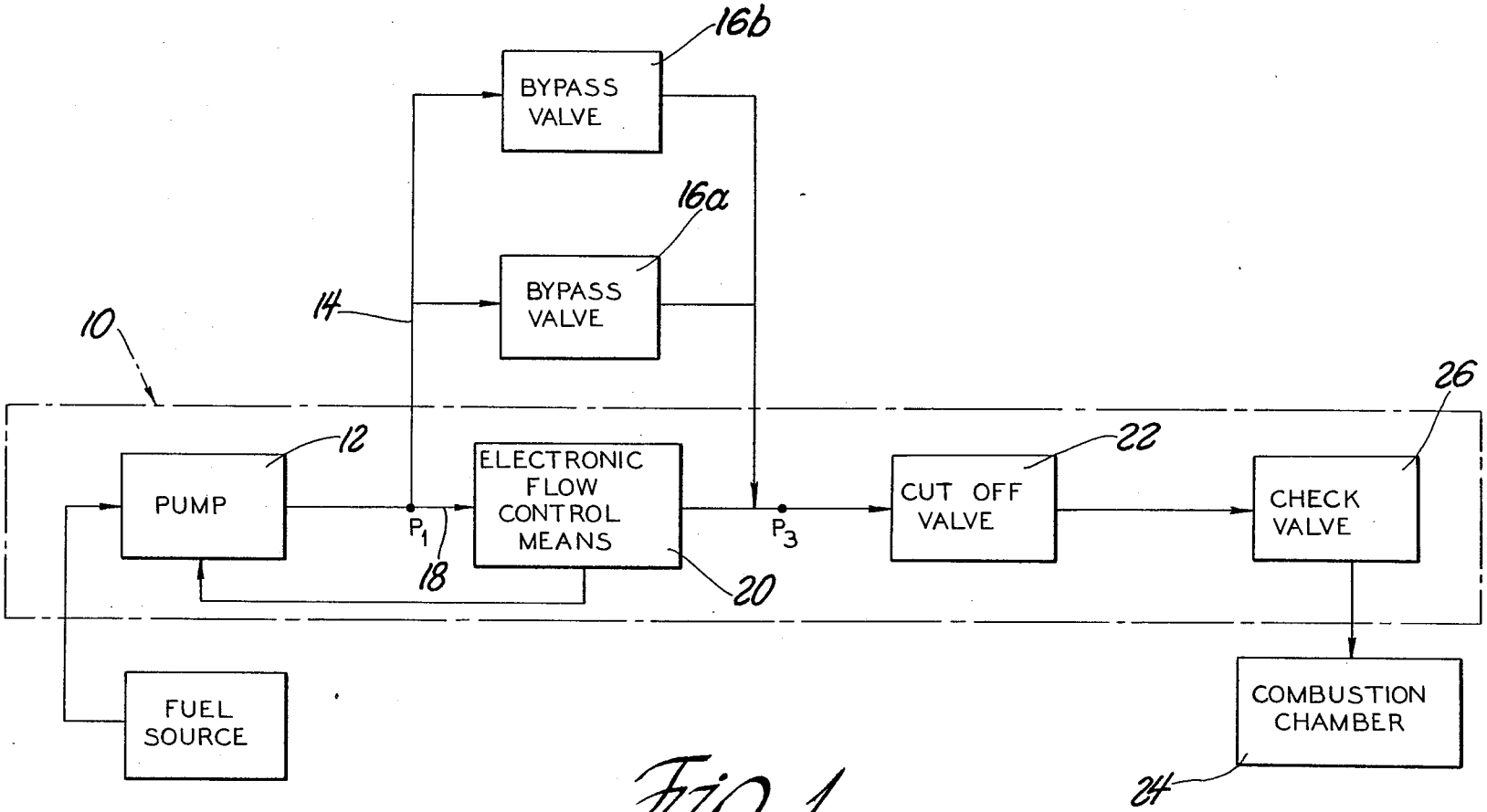
FIG. 1 is a simplified flow diagram of a hydromechanical unit and solenoid actuated bypass valves in parallel therewith.

FIG. 1 schematically shows a hydromechanical unit 10 for supplying fuel to a tank engine, the unit including a shaft driven constant-pressure fuel pump 12 typically operating with an output pressure of 500 to 1000 psi. Fuel from pump 12 passes through port $P_1$ which is open not only to line 14 leading to bypass valves 16*a*, 16*b* but is also open to line 18 which leads to an electronic flow control means 20. Bypass valves 16*a* and 16*b* are hydraulically in parallel with each other and in parallel with flow control means 20, the bypass valves having a downstream port $P_3$ in common with flow control means 20. Flow control means 20 passes only a regulated proportion of the fuel from the pump and returns the remaining fuel to the intake side of pump 12.

Figure 2:
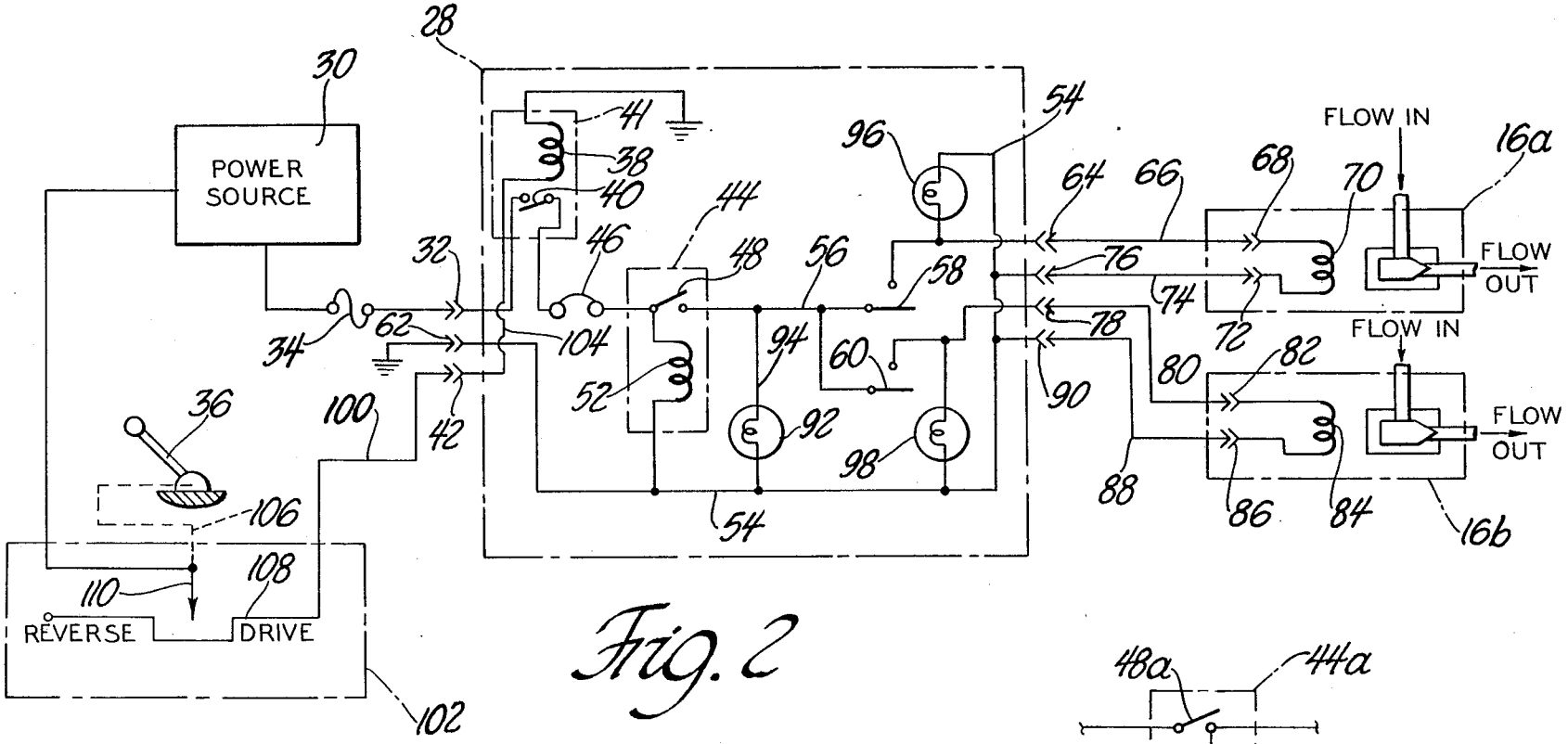
FIG. 2 is a schematic diagram of a control panel and the associated circuitry used to operate the solenoid valves.

Bypass valves 16*a* and 16*b* are fixed orifice, solenoid operated valves controlled from a remote panel 28 whose schematic diagram is part of FIG. 2. Although FIGS. 1 and 2 show only two bypass valves, it is possible to have three or more such valves hydraulically in parallel with each other and in parallel with flow control means 20. The bypass valves are fully open when electrically energized and are fully closed when de-energized. Immediately downstream of flow control means 20 and bypass valves 16*a* and 16*b* is a cut-off valve 22, which shuts off fuel flow to combustion chamber 24 of the engine whenever the engine stops. Both flow control means 20 and cut off valve 22 are controlled by an electronic control unit, or ECU (not shown). Between the cut off valve 22 and the combustion chamber is a check valve 26 to prevent fuel from entering the combustion chamber after the engine stops.

When the ECU receives signals indicative of conditions potentially dangerous to the engine, the ECU typically initiates a protective mode wherein it permits only a minimum or threshold level of fuel to pass through flow control means 20, thereby safeguarding the engine from damage. Likewise, if the ECU is disabled or electrical power to the flow control means is interrupted, the flow control means reverts to a default mode wherein this same minimum or threshold amount of fuel is delivered to the engine. If it is desired to increase the amount of fuel to the engine under these conditions, then one or both of bypass valves 16*a* or 16*b* may be opened. Bypass valves 16*a* and 16*b* operate independently of the ECU and are unaffected by the ECU's proteotive mode or power failure to the ECU. Preferably, valves 16*a* and 16*b* have unequal flow capacity, so that opening one, the other, or both gives three different fuel flow rates to the engine. Likewise, if additional bypass valves are connected in parallel with valves 16*a* and 16*b*, then all the valves should have unequal flow rates. In this way, the greatest possible number of flow rates can be achieved by opening and closing various combinations of bypass valves.

Referring now to FIG. 2, there is schematically shown a control panel 28, which is used to govern solenoid operated bypass valves 16*a* and 16*b*, the panel being selectively de-energized, depending on the position of transmission shift lever 36. The power source 30 for control panel 28 leads to a plug connection 32 on the panel, there being a fuse 34 between plug connection 32 and power source 30.

Downstream of and in series with plug connection 32 is relay switch 40, which is part of relay assembly 41. Relay switch 40 is preferably biased toward the open position by such means as a spring (not shown) and is closed by energization of coil 38. Relay assembly 41 is connected to another relay assembly 44, there being a circuit breaker 46 between the relay assemblies. Relay assembly 44 includes a master switch 48 biased toward the open position shown in FIG. 2 and held closed by energization of coil 52 with which switch 48 is connected in parallel.

Typically, switch 48 will be a toggle switch biased toward its open position as shown in FIG. 2. The strength of the bias is such that energization of coil 52 will exert insufficient magnetic force to close switch 48 but will generate enough force to hold switch 48 in position once the switch is manually closed. Opening switch 48 manually causes the switch to remain open even if coil 52 is subsequently energized. By manually opening switch 48, the vehicle operator simultaneously and quickly de-energizes and hence closes, all solenoid-operated bypass valves, such as those at 16*a* and 16*b*. Such quick, simultaneous closing of all the bypass valves is advantageous if immediate fuel flow stoppage is necessary to save the engine. The manual manually operable switch would be especially helpful if three or more bypass valves are used on our bypass mechanism. Additionally, manual switch opening and closing will simplify the task of intermittently sending a predetermined flow of fuel to the engine. Specifically, after the various bypass valve switches (as at 58, 60) have been set in open or closed positions, then switch 48 is repeatedly opened and closed to obtain intermittent flow of fuel at a predetermined rate to the engine.

Figure 2A:
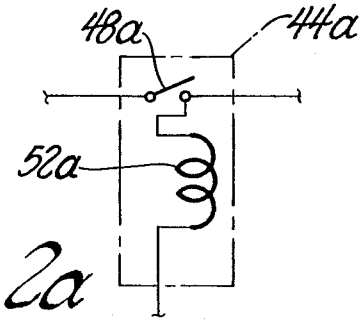
FIG. 2*a* is an alternate embodiment of a relay assembly shown in FIG. 2.

FIG. 2*a* shows at 44*a* a slightly modified form of relay assembly 44. Relay assembly 44*a* has a switch 48*a* biased to an open position at which coil 52*a* receives no current. Switch 48*a* must be manually closed before coil 52*a* can be energized. One advantage of relay assembly 44*a* is apparent when the tank driver reverses the direction of the tank. During this procedure, shift lever 36 necessarily moves contact 110 past the "neutral" zone of contact 108 wherein electrical connection between the contacts is broken, ultimately causing coil 52 to be de-energized. Consequently, switch 48 opens, whereby fuel flow through valves 16*a* and 16*b* is stopped. As with switch 48, the need to reclose switch 48 to activate the valves gives the driver an opportunity to change the positions of valve switches 58 and 60 (and hence motor speed) before the tank proceeds in the new direction. Unlike switch 48, however, the bias of switch 48*a* toward need not be strong enough to keep switch 48*a* open when coil 52*a* is energized, whereby greater design freedom is achieved in the selection of springs or other biasing devices for switch 48*a*. The lower end of coil 52 in FIG. 2 is connected to common ground line 54, which leads to ground pin connection 62 of control panel 28. The power-out line 56 from switch assembly 44 leads to electrically parallel solenoid switches, such as those at 58 and 60, which control the flow of electrical power to solenoid valves 16*a* and 16*b*, respectively. Power from switch 58 flows in series through plug connector 64, line 66, and plug connector 68 to coil 70, which is connected to common ground line 54 via plug connector 72, line 74, and plug connector 76. Similarly, power from switch 60 flows in series through plug connector 78, line 80, and plug connector 82 to coil 84, which is connected to common ground line 54 via plug connector 86, line 88 and plug connector 90.

Control panel 28 has a set of indicator lights to show the operational status of the circuitry within the panel. Power indicator light 92 is in line 94 connected between power out line 56 and common ground line 54, so that light 92 is in parallel with coil 52 and in series with switch 48. Light 92 illuminates when both switch 48 and switch 40 of switch assembly 44 are closed, and thus indicates when electrical power is available in line 56 for operating solenoid operated bypass valves 16*a* and 16*b*. "Valve open" light 96 is connected in parallel with coil 70, which opens bypass valve 16*a* when energized. Likewise, "valve open" light 98 is connected in parallel with coil 84, which opens bypass valve 16*b* when energized. Light 96 illuminates when switch 58 closes to permit current in line 56 to energize coil 70 and light 98 illuminates when switch 60 closes to permit current in line 56 to energize coil 84.

Connected to coil 38 of switch assembly 41 is switch 102 associated with transmission shift lever 36, the connection being made via line 100, plug connector 42 and line 104. Switch 102 allows or prevents the energization of coil 38 by power source 30. Slidable contact 110 of switch 102 is controlled by transmission shift lever 36 via a suitable mechanical linkage represented schematically by broken line 106. Slidable contact 110 disengages fixed contact 108 when transmission shift lever 36 is in a position corresponding to the "neutral" gear range or other selected gear range of the transmission. Slidable contact 110 will engage one end of fixed contact 108 when transmission shift lever 36 is in a position corresponding to the "drive" or "reverse" mode of the vehicle transmission.

OPERATION

If the ECU has entered a protective mode wherein fuel flow through the HMU to the engine has been severely restricted and the vehicle operator desires to bypass fuel around the HMU, then the operator first insures that transmission shift lever 36 is in either the "reverse" or "drive" range and closes switch 48, whereupon coil 52 is energized, indicator light 92 illuminates to show that control panel 28 is receiving power. The operator then closes switch 58 to permit fuel flow through solenoid-operated bypass valve 16*a*, or closes switch 60 to permit fuel flow through solenoid operated bypass valve 16*b* or closes both of these switches to permit fuel flow through both valves, depending on how much power is required by the engine.

If the operator desires to shift the vehicle transmission from the drive range to the reverse range or, vice versa, then the transmission shift lever must be moved through its "neutral" position where it causes switch 102 to open. The opening of switch 102 causes de-energization of coil 38, the opening of switch 40 and de-energization of coil 52. Consequently, master switch 48 reverts to its open position, power to solenoid-operated bypass valves 16*a* and 16*b* is cut off, and fuel flow through these valves ceases. Stopping fuel flow through the bypass valves when the transmission is in the neutral range keeps the engine from overspeeding while not under load.

We wish it to be understood that we do not desire to be limited to the exact details of the various constructions shown herein because obvious modifications may occur to these skilled in the relevant arts without departing from the scope of the following claims.

We claim:

1. A system for supplying fuel to the engine of a combat vehicle having a manually operable transmission and a shift lever for shifting gears in the transmission, comprising:

a source of fluid fuel;

a constant pressure pump hydraulically connected to the source of fluid fuel;

electronically controlled means for regulating the flow of fuel from the pump to the engine;

a plurality of electrically operated bypass valves hydraulically in parallel with one another and with the regulating means;

an electrical power source for energizing the bypass valves;

an interrupter switch electrically connected between the power source and the bypass valves;

an interrupter coil to open the interrupter switch when the interrupter coil is energized;

a lever switch controlled by the transmission lever connected between the power source and the interrupter coil;

a master switch electrically connected between the interrupter switch and the bypass valves;

a master coil in series with the master switch to magnetically maintain the master switch in its closed position when the master coil is energized;

a plurality of manually actuated valve control switches electrically in parallel with one another and in series with the master switch, one of the electrically operated bypass valves being connected in series with a corresponding valve control switch.

2. The fuel system of claim 1 wherein the shift lever has positions corresponding to the drive, neutral and reverse gears of the vehicle transmission, and wherein the shift lever opens the lever switch when the transmission is in the neutral gear and closes the lever switch when the transmission is in the drive gear or the reverse gear.

3. A mechanism for routing fuel around a fuel flow regulator of a vehicle, comprising:

a plurality of electrically actuatable bypass valves hydraulically in parallel with one another and in parallel with the regulator;

an electrical power source for energizing the bypass valves;

an interrupter switch connected in series between the power source and the valves;

means to open and close the interrupter switch in response to a transmission gear shifting mechanism for the vehicle;

a manually closable master switch connected in series between the interrupter switch and the bypass valves;

an electrically actuated closure means in series with the master switch for maintaining the master switch in a closed condition when current flows through the closure means;

a manually operable valve switch electrically in series with each valve, the valve switches being in hydraulically parallel with one another.

4. The mechanism of claim 3 wherein the bypass valves are fully open when electrically energized and fully closed when not electrically energized.

5. The mechanism of claim 3 wherein each bypass valve has a differently sized orifice.

6. The mechanism of claim 3 wherein the interrupter switch is mechanically biased to an open position.

7. The mechanism of claim 3 wherein the master switch is mechanically biased toward the open position;

8. The mechanism of claim 3 wherein the means to open and close the interrupter switch includes an electromagnetic coil to open the interrupter switch.

9. The mechanism of claim 3 wherein the bypass valves have quick-disconnect fittings for hydraulic connection in parallel with the regulator.

10. The mechanism of claim 9 wherein the bypass valves are removably attached to lines leading from the switches, whereby the bypass valves can be easily replaced by other valves having different flow capacities than the bypass valves.

11. The mechanism of claim 3 including a means to manually open the master switch against the action of the closure means.

* * * * *